United States Patent [19]

Boucherie

[11] Patent Number: 4,603,912

[45] Date of Patent: Aug. 5, 1986

[54] BRUSH MANUFACTURING MACHINE

[75] Inventor: Leonel P. Boucherie, Roeselare-Rumbeke, Belgium

[73] Assignee: Firma G.B. Boucherie, Belgium

[21] Appl. No.: 744,301

[22] Filed: Jun. 13, 1985

Related U.S. Application Data

[63] Continuation of Ser. No. 470,951, Mar. 1, 1983, abandoned.

[30] Foreign Application Priority Data

Mar. 4, 1982 [BE] Belgium ..... 2/59614

[51] Int. Cl.[4] ..... B25B 1/20; B25B 11/00

[52] U.S. Cl. ..... 300/2; 300/10; 300/11

[58] Field of Search ..... 300/1-11

[56] References Cited

U.S. PATENT DOCUMENTS

| | | | |
|---|---|---|---|
| 3,241,886 | 3/1966 | Zahoransky et al. | 300/3 |
| 3,295,893 | 1/1967 | Adams | 300/1 X |
| 3,858,941 | 1/1975 | Boucherie | 300/3 |

FOREIGN PATENT DOCUMENTS

| | | | |
|---|---|---|---|
| 134724 | 3/1979 | Fed. Rep. of Germany | 300/10 |
| 3016791 | 11/1981 | Fed. Rep. of Germany | 300/2 |

*Primary Examiner*—Howard N. Goldberg
*Assistant Examiner*—Timothy V. Eley
*Attorney, Agent, or Firm*—Bacon & Thomas

[57] ABSTRACT

A brush manufacturing machine comprising a brush body carrier for holding a brush body by its opposite ends, the carrier including two clamping components disposed in line with each other for engaging the opposite ends of the brush body, the clamping components being carried on rotatable pins that move the components towards and away from each other and rotate the brush body.

8 Claims, 8 Drawing Figures

BRUSH MANUFACTURING MACHINE

This application is a continuation of application Ser. No. 470,951, filed 3-1-83 now abandoned.

BACKGROUND OF THE INVENTION

The present invention relates to a brush manufacturing machine, more especially a machine for manufacturing brushes, more especially still for manufacturing finger nail brushes which, at least in two places, are provided with series of fibres.

It is known that so called finger nail brushes are made with fibres on both sides of same, the planting of both series of fibres being usually different.

It is also known that for fitting each series of fibres the brush bodies must be taken up into another machine, which does not only require a big investment that badly influences the costs of the manufactured products, this cost price being however also disadvantageously influenced through the fact that the number of treatments to which the brush body must be submitted before all fibres are planted is comparatively high.

Thus the present invention relates to a brush manufacturing machine for manufacturing brushes of the aforesaid type, in which the fitment and/or all operations on the two or more series of fibres which such a brush shows can be carried out on a single machine.

SUMMARY OF THE INVENTION

For this purpose, this machine mainly consists in the brush body carrier having two clamping components mounted in line, one behind the other, which engages the opposite ends of a brush body carrier; and means which axially act on pins in order to move them towards one another or away from one another, and means for imparting rotary movement to the aforesaid pins.

BRIEF DESCRIPTION OF THE DRAWINGS

For a better understanding of the machine according to the invention a preferred embodiment of this machine will be described hereinafter by way of specific example, this example having no limitative purpose, however. It will be understood that it is capable of further modification. In the example reference is made to the accompanying FIGS. 1 to 8.

In FIG. 1 there is schematically shown a brush manufacturing machine 1 which mainly consists of a drum 2 that is rotatable around a shaft 3, this drum, in the present case, being provided with four brush body carriers, respectively 4, 5, 6 and 7, which are each intended for fixing in a suitable position and to move two brush bodies, respectively brushes 8 and 9.

Figure 1:
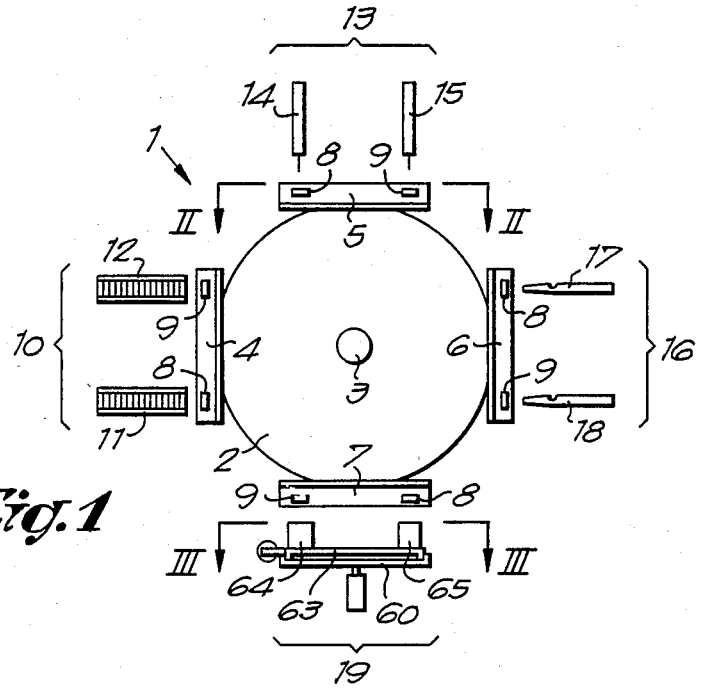
FIG. 1 shows a schematic view of a brush manufacturing machine of the drum type, which is intended for producing brushes which have at least two series of fibres located in different planes.

Around the drum 2, at angles of 90°, four working stations are provided for, respectively, a first working station 10 which is constituted by two magazines, respectively 11 and 12; a second working station 13, which consists of two drilling tools, respectively 14 and 15; a third working station 16, that consists of two filling tools, respectively 17 and 18, and a fourth working station 19 which will be described more in detail hereinafter and which is constituted by a device for finishing, more especially for cutting or shaving, the brush fibres.

The brush body carriers 4 through 7 are each formed in a similar way and substantially consists of a basis plate 20 on which are fixed two supports, respectively 21 and 22, in which freely rotatable and axially movable pins, respectively 23–24 and 25–26, are fitted, the ends facing each other of which are provided with clamping components, respectively 27–28 and 29–30, which are suitably profiled in relation to the shape of the ends of the brush bodies 8 and 9.

In front of each brush body 8–9, on the basis plate 20, there is fixed a pressure cylinder, respectively 31–32, the outgoing piston rods 33–34 of which continuously act on the ends, respectively 35–36, of levers 37–38 which are hinged on pins, respectively 39 and 40, fixed on the basis plate 20.

The ends 35–36 of the levers 37–38 furthermore act directly on the aforesaid pins 24–26, whilst at their opposite end, by means of suitable pins 41–42, these levers 37–38 are hinged to rods, respectively 43–44, the free ends of which are provided with bent parts, respectively 45–46, which can act on an aforesaid pin 23–26.

Figure 2:
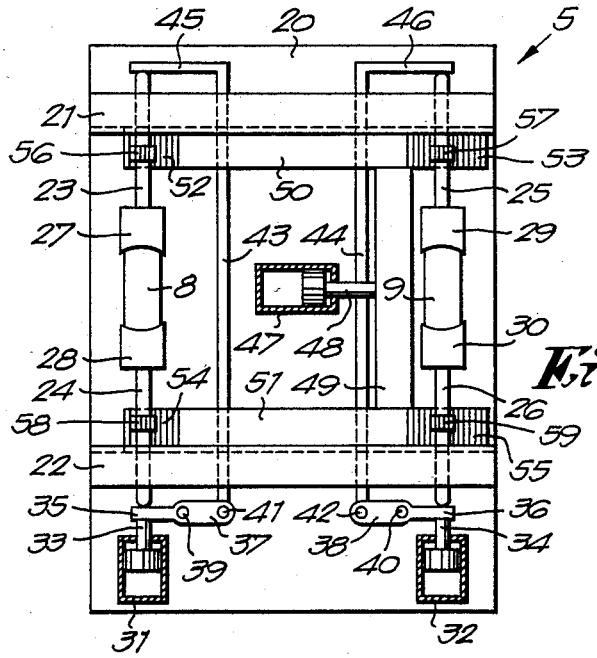
FIG. 2 shows a view according to line II—II in FIG. 1, more especially relating to the brush body carrier.

The brush body carrier according to FIG. 2 is furthermore completed by a pressure cylinder 47, which is also fixed on the basis plate 20 and the outgoing piston rod 48 of which is assembled with a bridge piece 49 which fixedly joins two racks 50 and 51, respectively, these racks being suitably kept slidable in the correct position, for instance in relation to the aforesaid supports 21 and 22, and being provided on their free ends with a series of teeth, respectively 52–53 and 54–55, which are continuously in mesh with small pinions, respectively 56–57 and 58–59 which are fixed on the aforesaid pins 23 through 26.

The width of the toothed rack 52 through 55 is such that the pinions 56 through 59, during their axial motions with the pins on which they are fixed, always remain in contact with these toothed racks.

The operation of the brush body carrier as described hereinabove is very simple.

At first, the pistons of the cylinders 31 and 32 are completely retracted, whereby the ends 35–36 of the levers 37–38 as well as the ends 45–46 of the rods 43–44 are spaced from one another in such a way that between the clamping components 27–28 and 29–30 brush bodies 8 and 9 can be placed, while these brush bodies 8, 9 can be kept at the suitable level in relation to the clamping components 27 through 30 by providing each of these clamping components with means (not shown) located under the brush bodies 8 and 9, such as a projection to support these brush bodies temporarily.

Then, when the pistons of the cylinders 31–32, are extended; the levers 37 and 38 rock on the shafts 39 and 40 and the ends 35–36 as well as 45–46 press on the pins 23 through 26, whereby these pins slide in the supports 21 and 22 and suitably engage the opposite ends of brush bodies 8 and 9 in order to fix same firmly and in the correct position in these clamping components.

Thereafter, the brush body carrier will move from under the working station 10 to under the working station 13 and in the side which is the upside at this moment small holes will be drilled at the correct points, the whole brush body carrier being moved, in a known way, for that purpose.

After all small holes are drilled in the upside of the brush body, the cylinder 47 is suitably energized, thereby causing toothed racks 52 through 55 to be simultaneously moved in order to bring another side, usually the opposite side, of the brush body upside, by rotation over an angle of 180°, after which small holes can be drilled in this second side, in a known way and eventually with another configuration.

After this brush body carrier becomes moved to the working station 16, where the aforesaid operations are being repeated, with the difference being that at this moment, the fibres are implanted, first on one side and then on the second side of the brush body.

When this operation is performed, the brush body carrier is finally moved down opposite the working station 19.

The device 19 mainly consists of a table 60 which is fixed on the piston rod 61 of a pressure cylinder 62, whilst on this table a sliding carriage 63 can be moved, on which two series of cutting means, respectively 64–65 and 66–67 are fixed.

Furthermore, the sliding carriage 63 is assembled with the free end of the piston rod 68 of a pressure cylinder 69, which itself is assembled with a pressure cylinder 70, the piston rod 71 of which is assembled with the table 60.

The operation of this device 19 in itself is also very simple.

As appears from the drawings, it is apparent that the brush which one wants to obtain is provided on one side with fibres 72 which are directed perpendicularly on a side face of the brush body while on the opposite side face of the brush body fibres 73–74 are provided for, which are planted obliquely and in a convergent way in the brush body.

Figure 3:
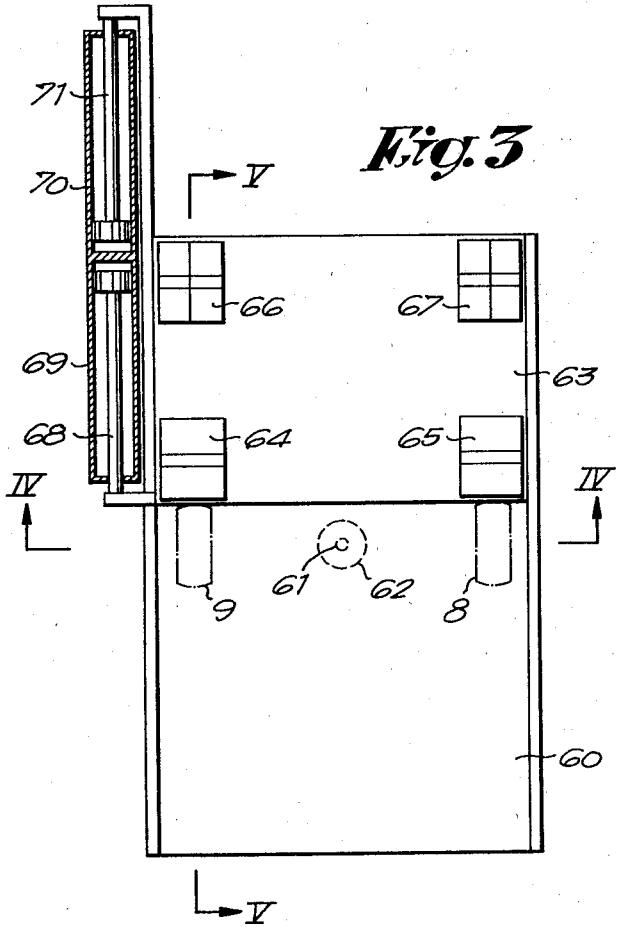
FIG. 3 shows on a larger scale a view according to line III—III in FIG. 1.
Figure 4:
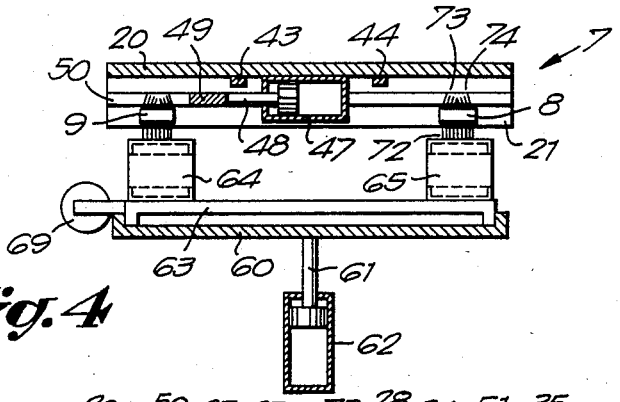
FIGS. 4 and 5 show respectively sections according to lines IV—IV and V—V in FIG. 3.
Figure 5:
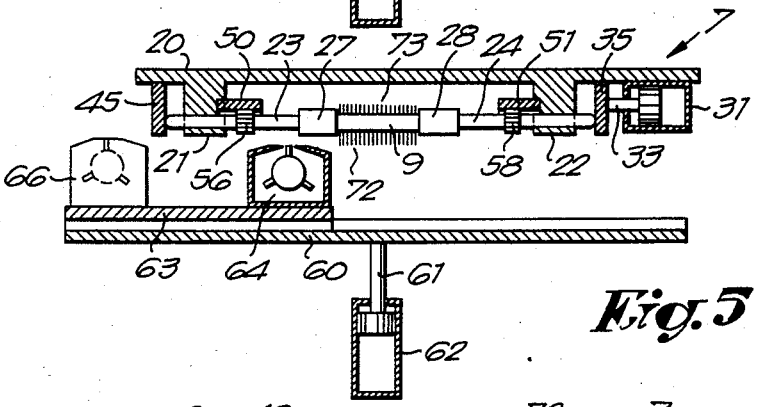
Figure 7:
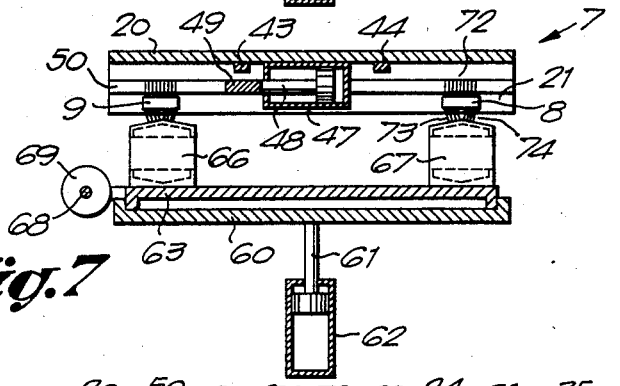
FIGS. 7 and 8 show respectively sections according to the lines VII—VII and VIII—VIII in FIG. 6.
Figure 8:
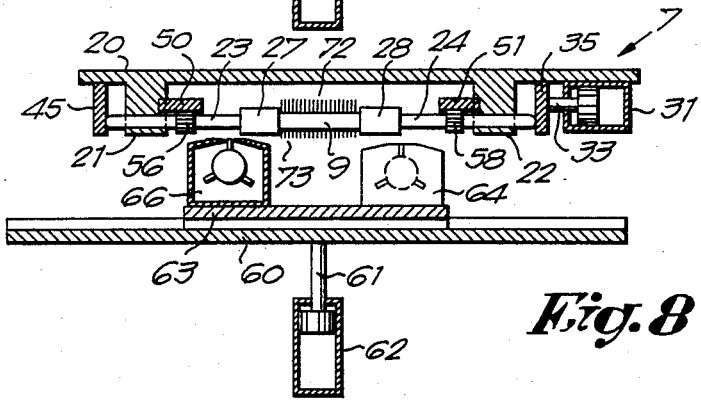

When, in this case, the brushes 8, 9 shaped in this way are brought above the device 19, the fibres 72 will first be cut, for which purpose the cutting devices 64 and 65 are located under the fibres 72, as shown in the FIGS. 3 through 5.

At this moment the piston of the cylinder 62 is in its top position and the pistons of the cylinders 69 and 70 are both pushed in.

Figure 6:
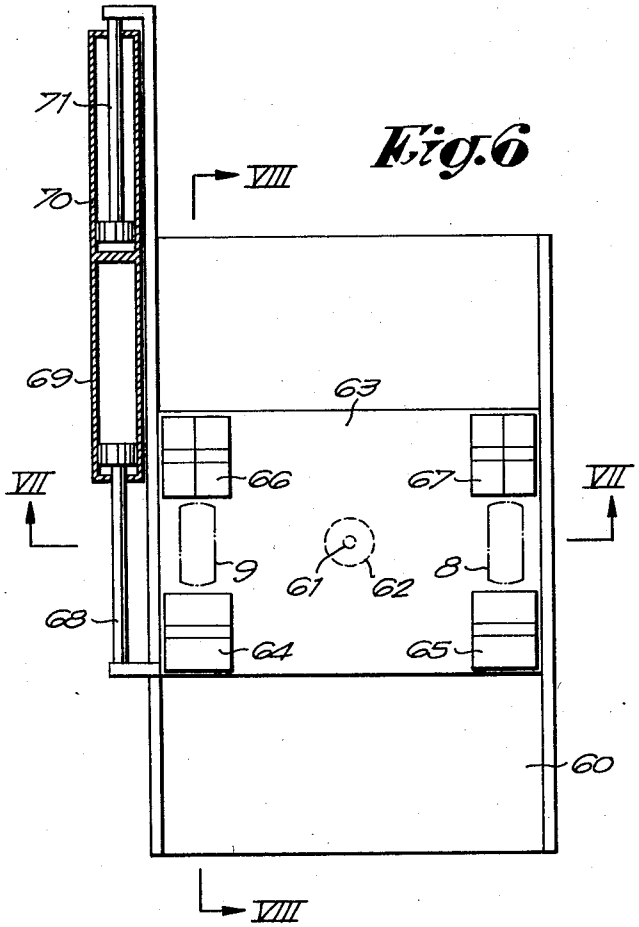
FIG. 6 shows a view similar to the one of FIG. 3, but with the device in a second characteristic position.

Then cylinder 70 becomes energized and will cause a motion of the sliding carriage 63 which is such that the cutting or shaving components 64 and 65 move to and fro from the position as shown in FIG. 3 to the position as shown in FIG. 6, until all fibres 72 are equally cut.

After this, cylinder 62 becomes energized and the table 60 with sliding carriage 63 becomes moved downwards so that, by means of the aforesaid cylinder 47 the brushes 8 and 9, in this case, can be turned through 180°, after which cylinder 62 causes the table 60 with the sliding carriage 63 and the cutting devices 64 through 67 to come again into the upper position.

At the same time, cylinder 69 has been energized, whereby the cutting devices 66 and 67 have come into the position as shown in FIG. 6, in other words the cutting devices 66 and 67 which are provided with oblique knives, which allow to cut the ends of the fibres 73 and 74 obliquely, are moved forward and the cutting operation is obtained through alternatively energizing the piston of the cylinder 70, in order to move the cutting knives to and fro under the fibres 73 and 74.

It is clear that in this way one obtains a device which permits the production of brushes on which on two or more faces fibres are planted, it being sufficient, by means of the cylinder 47, to turn the brush bodies 8 and 9 through a suitable angle in order, after a certain operation is performed, to carry out the same operation or a similar operation on another face of the brush, while, for cutting brush hairs in the device 19, suitable knives may be utilized and caused to be moved to and fro in order to suitably cut the brush hairs of the fibres into the desired profile.

The aforesaid cylinder 62, which becomes energized when the brushes must be turned above the device 19, will also become energized when the sliding carriage 63 is moved, in other words when the cylinder 69 is operating, when the drum 2 is being turned, and when the brush body carriers are being transported from one working station to another.

In order finally to liberate the manufactured brushes, cylinders 31–32 are energized so as to retract their pistons. In order to assure such liberation, the pins 23 through 26 can be provided with drawback means which are not shown, for instance drawback springs.

What I claim is:

1. A machine for manufacturing a plural faced brush wherein manufacturing operations are performed on individual faces of a brush body comprising:

(a) a brush body carrier;

(b) clamping means mounted on the brush body carrier including two clamping components disposed in line with each other having means for engaging ends of the brush body attached to axially movable pins;

(c) means for moving the pins axially such that the clamping components are moved toward or away from each other so as to clamp the brush body therebetween;

(d) indexing means to turn the pins, the clamping components and the brush body engaged therein through an angle of less than 360° and to subsequently hold the brush body stationary so as to permit manufacturing operations to be separately performed on each face of the brush body; and, (e) means to transport the brush body carrier between a plurality of manufacturing operation stations.

2. A brush manufacturing machine according to claim 1 wherein portions of the clamping components engaging the brush body are configured in the same shape as the ends of the brush body.

3. The brush manufacturing machine of claim 1 wherein the means for moving the pins axially comprises:

(a) a fluid cylinder and piston assembly mounted on the brush body carrier; and, (b) a lever system operatively connected to the piston of the assembly and to the pins for causing the pins to be simultaneously moved in opposite directions towards or away from each other upon actuation of the fluid cylinder and piston assembly.

4. The brush manufacturing machine according to claim 1 further comprising:

(a) drilling means to drill a plurality of holes in each of the faces of the brush body;

(b) inserting means to insert brush fibers in the holes formed in each of the faces of the brush body; and, (c) trimming means to trim the ends of the brush fibers into a predetermined shape.

5. The brush manufacturing machine according to claim 4 wherein brush fibers are inserted on opposite faces of the brush body and wherein the trimming means comprises means to form the distal ends of the brush fibers on a first face in a shape different from the distal ends of the brush fibers on a second face.

6. The brush manufacturing machine according to claim 5 wherein the trimming means comprises:

(a) a first cutter having a first cutting shape;

(b) a second cutter having a second cutting shape;

(c) means to move the first cutter in contact with the distal ends of the brush fibers extending from a first face of the brush body; and, (d) means to move the second cutter in contact with the distal ends of the brush fibers extending from a second face of the brush body after the brush body has been turned approximately 180° by the indexing means.

7. A machine for manufacturing a plural faced brush wherein manufacturing operations are performed on individual faces of a brush body comprising:

(a) a brush body carrier;

(b) clamping means mounted on the brush body carrier including two clamping components disposed in line with each other having means for engaging ends of the brush body attached to axially movable pins;

(c) means for moving the pins axially such that the clamping components are moved toward or away from each other so as to clamp the brush body therebetween; and, (d) indexing means to turn the pins, the clamping components and the brush body engaged therein through an angle of less than 360° and to subsequently hold the brush body stationary so as to permit manufacturing operations to be separately performed on each face of the brush body the indexing means comprising:

(i) two parallel toothed racks, slidably attached to the brush body carrier;

(ii) a pinion carried on each pin, each pinion being in constant meshed engagement with a corresponding rack; and, (iii) means to move the racks thereby causing the pinions and associated pins to turn about their axes.

8. The brush manufacturing machine of claim 7 further including means for joining the toothed racks together, and a fluid cylinder and piston assembly for moving the racks to rotate the pins.

* * * * *